US006419357B2

(12) United States Patent
Yoshino et al.

(10) Patent No.: US 6,419,357 B2
(45) **Date of Patent: *Jul. 16, 2002**

(54) PRINTING APPARATUS

(75) Inventors: Hiroshi Yoshino, Yokohama; Toshiaki Harada, Kawasaki, both of (JP)

(73) Assignee: Canon Kabushiki Kaisha, Tokyo (JP)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 08/904,473

(22) Filed: Aug. 4, 1997

(30) Foreign Application Priority Data

| | | |
|---|---|---|
| Aug. 12, 1996 | (JP) | 8-212523 |
| Feb. 14, 1997 | (JP) | 9-030502 |
| Apr. 28, 1997 | (JP) | 9-111588 |

(51) Int. Cl.[7] ..... B41J 2/01
(52) U.S. Cl. ..... 347/108
(58) Field of Search ..... 347/108, 104; 400/120.1, 120.2

(56) References Cited

U.S. PATENT DOCUMENTS

| | | | | |
|---|---|---|---|---|
| 4,847,640 A | * | 7/1989 | Murakami | |
| 5,019,839 A | * | 5/1991 | Watanabe et al. | 400/120 |
| 5,182,697 A | | 1/1993 | I-Shou | 361/683 |
| 5,308,173 A | | 5/1994 | Amano et al. | 400/29 |
| 5,479,193 A | * | 12/1995 | Shimoda et al. | 347/7 |
| 5,652,608 A | * | 7/1997 | Watanabe et al. | 347/50 |

FOREIGN PATENT DOCUMENTS

| | | |
|---|---|---|
| EP | 0 288 089 | 10/1988 |
| EP | 451828 | * 10/1991 |
| EP | 0 540 301 | 5/1993 |
| JP | 6-218965 | 8/1994 |
| WO | WO 91/14221 | 9/1991 |

* cited by examiner

*Primary Examiner*—John Barlow
*Assistant Examiner*—Michael S Brooke
(74) *Attorney, Agent, or Firm*—Fitzpatrick, Cella, Harper & Scinto

(57) ABSTRACT

A printing apparatus having a housing formed with a containing portion in which a power source unit for effecting printing on a printing medium is removably contained includes a power source portion forming a path for the printing medium provided on the power source unit.

13 Claims, 9 Drawing Sheets

PRINTING APPARATUS

BACKGROUND OF THE INVENTION

1. Field of the Invention

This invention relates to a printing apparatus having a housing formed with a containing portion in which a power source unit for effecting printing on a printing medium is removably contained.

2. Related Background Art

Printing apparatuses for forming images such as characters on a printing medium are widely used for individual use and business purposes. It has generally often been the case that plain paper is used as the printing medium, but with the recent development of the printing technique, metal plates, fabrics, etc. have also come to be used as the printing mediums. In order to cope with such many kinds of printing mediums, there is also known a printing apparatus having a plurality of medium conveying paths, one of which is made straight.

FIG. 13 of the accompanying drawings is a cross-sectional view of the essential portions of an ink jet printing apparatus having such two conveying paths as described above.

Arrow $P_A$ indicates an automatic conveying path, and arrow $P_M$ indicates a manual conveying path. A printing medium conveyed from the automatic conveying path $P_A$ or the manual conveying path $P_M$ is conveyed onto a platen 101 and is printed there, and is conveyed out in the direction of arrow A. The reference numeral 102 designates a head cartridge, the reference numeral 103 denotes an ink tank for storing ink therein, and the reference numeral 104 designates a printing head for receiving the supply of the ink from the ink tank 103 and effecting printing. That is, the ink is discharged from the printing head 104 toward the platen 101, whereby printing is effected on the printing medium. In this case, printing is effected with the printing medium which has been guided onto the platen 101 via the automatic conveying path $P_A$ or the manual conveying path $P_M$ being held by and between a pair of guide rollers 105 and a pair of pinch rollers 106 provided forwardly and rearwardly of the platen 101.

The printing mediums to pass along the automatic conveying path $P_A$ are placed as a paper stack 109 on a receiving plate 108 disposed on a paper supply tray 107. The uppermost sheet of the paper stack 109 is picked up by a paper supply roller 110 and is conveyed onto the platen 101 via the automatic conveying route $P_A$.

The paper supply roller 110 is supported on the paper supply tray 107 through a paper supply roller shaft 111, and during paper supply, it is rotated by a drive force obtained from drive means, not shown. Also, the receiving plate 108 is supported on the paper supply tray 107 through a pin 112, and during paper supply, it is elevated so as to approach the paper supply roller 110 by drive means, not shown, and the uppermost sheet of the paper stack 109 is adapted to resiliently contact with the paper supply roller 110.

On the other hand, the printing medium to pass along the manual conveying path $P_M$ is inserted from between a medium conveying path forming surface 114 provided on an outer case 113 as a housing and the medium conveying path auxiliary forming surface 116 of a side guide 115 for manual insertion, and passes along the manual conveying path $P_M$ and is guided onto the platen 101. The side guide 115 for manual insertion is provided in opposed relationship with a fixed side guide, not shown, in order to cooperate with this fixed sideguide to regulate the position of the printing medium in a direction perpendicular to the direction of conveyance of the printing medium passing along the manual conveying path $P_M$. The side guide 115 for manual insertion is slidably mounted on a pair of side guide restraining portions 117 provided upstream and downstream of the medium conveying path forming surface 114, and is movable in accordance with the width of the printing medium.

A power source unit 119 formed with a connector 118 to be connected to an AC power source, not shown, is disposed in the outer case 113 located under the manual conveying path $P_M$. Further, a circuit substrate including an element for converting an AC power source into a direct current of a predetermined voltage is contained in the power source unit 119.

In the printing apparatus as shown in FIG. 13, the manual conveying path $P_M$ is located between the paper supply tray 107 and the power source unit 119 and therefore, the total height of the printing apparatus is great, and this has led to the tendency that the installation space for the printing apparatus necessarily increases or the costs of the materials of the printing apparatus body becomes higher.

Also, there is a case where printing is effected on a printing medium of a short sheet length such as a postcard for lateral printing by way of the manual conveying path $P_M$. When at such time, improper conveyance occurs due to some or other cause, it has been difficult to take the printing medium which has caused the improper conveyance out of the apparatus.

On the other hand, in a compact apparatus wherein particular importance is attached to portability, the mounting and dismounting of the power source unit 119 with respect to the outer case 113 are possible, and if design is made such that this can be done simply, there is the possibility of a user removing the power source unit 119 from the outer case 113 during the printing operation by mistake and causing failure of the printing operation or imparting serious damage to the printing apparatus. Therefore, generally, the printing apparatuses are designed such that a user cannot simply remove the power source unit 119 from the outer case 113.

Accordingly, when a trouble occurs to the power source unit 119 or a trouble such as jam regarding the conveyance of the printing medium occurs, there is a case where a user cannot quickly cope with the trouble, and each time a trouble occurs, the repair work by a serviceman becomes necessary, and this has led to the possibility that the convenience of use of the printing apparatus becomes very poor.

SUMMARY OF THE INVENTION

It is an object of the present invention to provide a printing apparatus of which the total height can be made small to thereby reduce the installation space and the cost of the material of a housing and in which the position of a printing medium in a direction perpendicular to the direction of conveyance of the printing medium can be stabilized to thereby improve the conveying performance therefor and moreover improve the maintenance property.

It is another object of the present invention to provide a printing apparatus with respect to which a user can simply mount and dismount a power source unit and moreover in which various troubles attributable to the power source unit being removed during the printing work by mistake can be obviated.

It is still another object of the present invention to provide a printing apparatus which has a housing formed with a containing portion in which a power source unit for effecting printing on a printing medium is removably contained and in which the power source unit has a power source portion forming a path for the printing medium.

It is yet still another object of the present invention to provide a printing apparatus which has a housing formed with a containing portion in which a power source unit for effecting printing on a printing medium is removably contained and which is provided with an opening portion formed in the housing so as to face the containing portion for putting the power source unit into and out of the apparatus therethrough, and at least a pair of restraining means formed on the housing and the power source unit for fixing the power source unit in its restrained state in the containing portion, the restrained state being manually releasable.

It is a further object of the present invention to provide a printing apparatus in which a power source unit is fixed in its restrained state in the containing portion of a housing by the engagement of restraining means and the power source unit cannot be taken out of the containing portion by simply pulling the power source unit, and when the power source unit is to be removed from the housing, the engagement of the restraining means can be released and the power source unit can be pulled out of the containing portion, and as long as the engagement of the restraining means is not released, the power source unit cannot be removed from the containing portion.

It is still a further object of the present invention to provide a printing apparatus which has a housing formed with a containing portion in which a power source unit for effecting printing on a printing medium is removably contained, and in which the power source unit has a power source portion forming a path for the printing medium, and which is provided with an opening portion formed in the housing so as to face the containing portion for putting the power source unit into and out of the apparatus therethrough, and at least a pair of restraining means formed on the housing and the power source portion for fixing the power source unit in its restrained state in the containing portion, the restrained state being manually releasable.

It is yet still a further object of the present invention to provide a printing apparatus in which a path for a printing medium is formed in a power source portion and the printing medium may be conveyed through the path, and by the engagement of engaging means, a power source unit is fixed in its restrained state in the containing portion of a housing, and the power source unit cannot be taken out of the containing portion by simply pulling the power source unit.

DESCRIPTION OF THE PREFERRED EMBODIMENTS

An embodiment in which a printing apparatus according to the present invention is applied to an ink jet printing apparatus will hereinafter be described in detail with reference to FIGS. 1 to 8, whereas the present invention is not restricted to such an embodiment, but can also be applied to other printing apparatuses involving similar problems.

Figure 1:
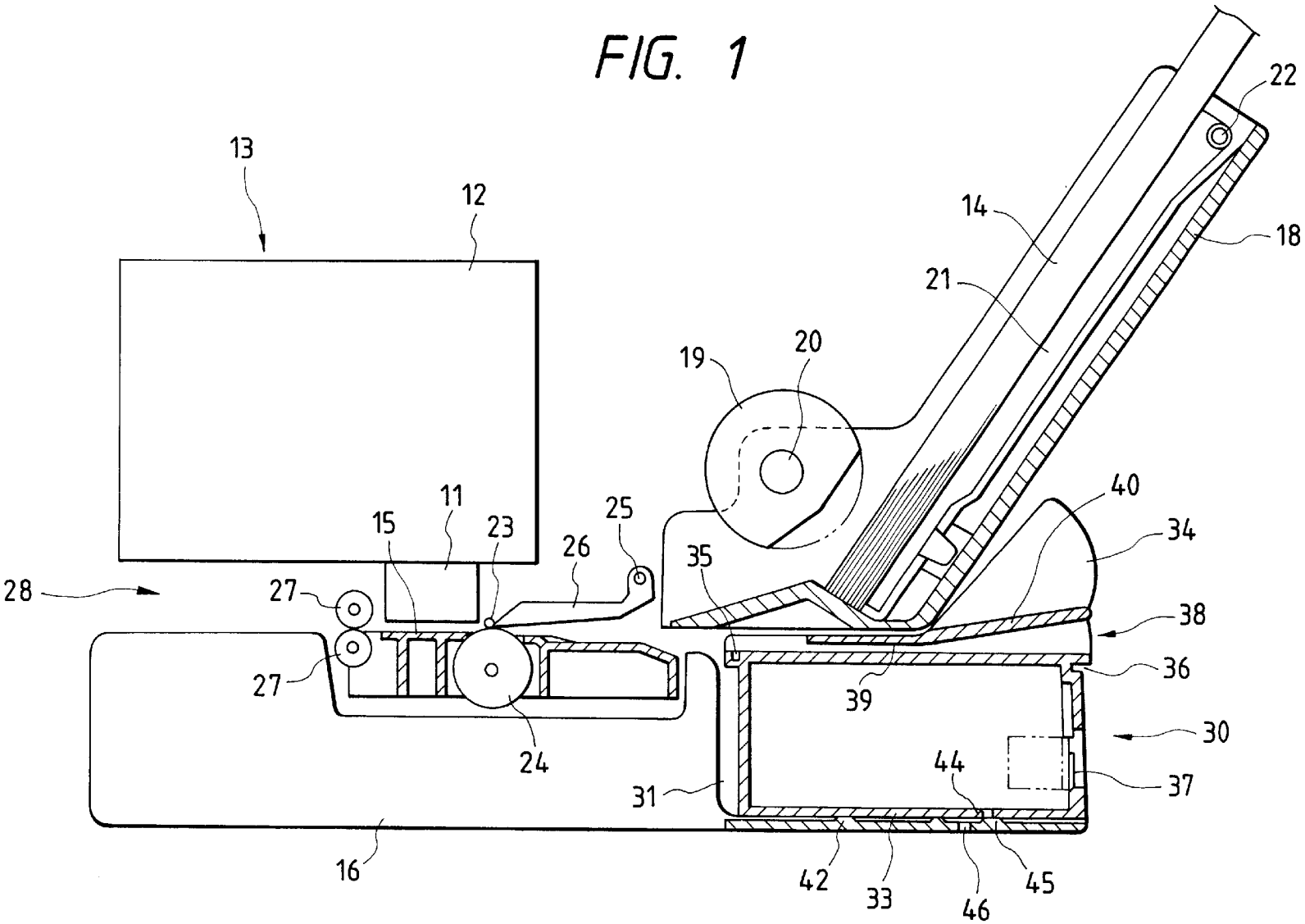
FIG. 1 is a conceptional view of mechanism schematically representing the structure of a first embodiment of a printing apparatus according to the present invention.
Figure 2:
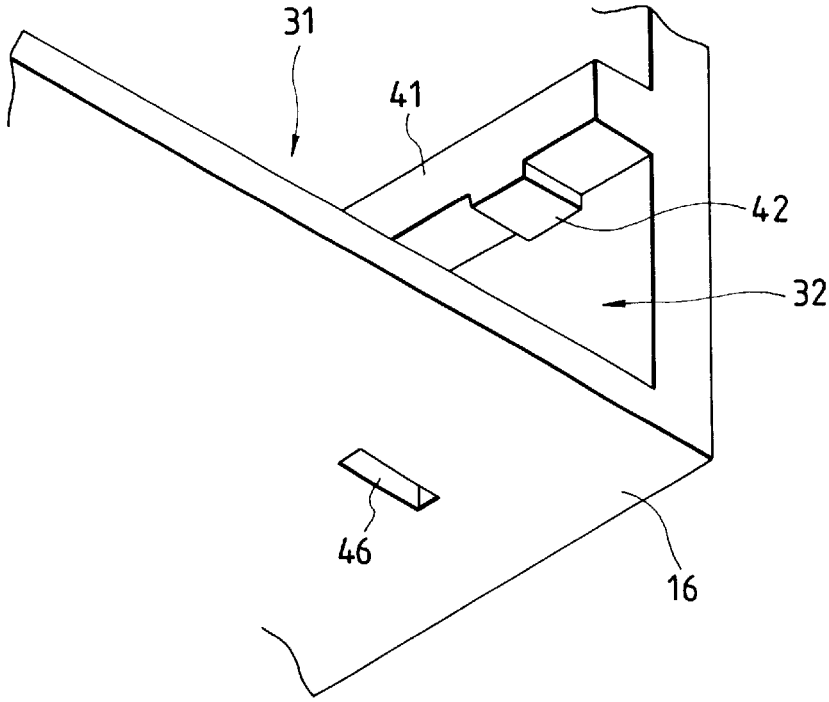
FIG. 2 is an enlarged perspective view of the bottom portion of a housing in the first embodiment of the present invention shown in FIG. 1.
Figure 3:
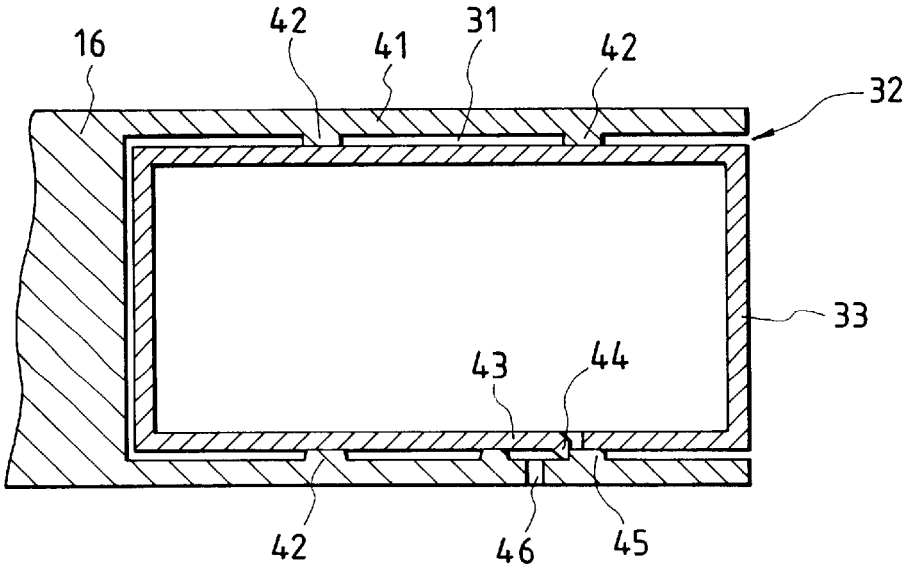
FIG. 3 is an enlarged cross-sectional view of a containing portion in the first embodiment of the present invention.
Figure 4:
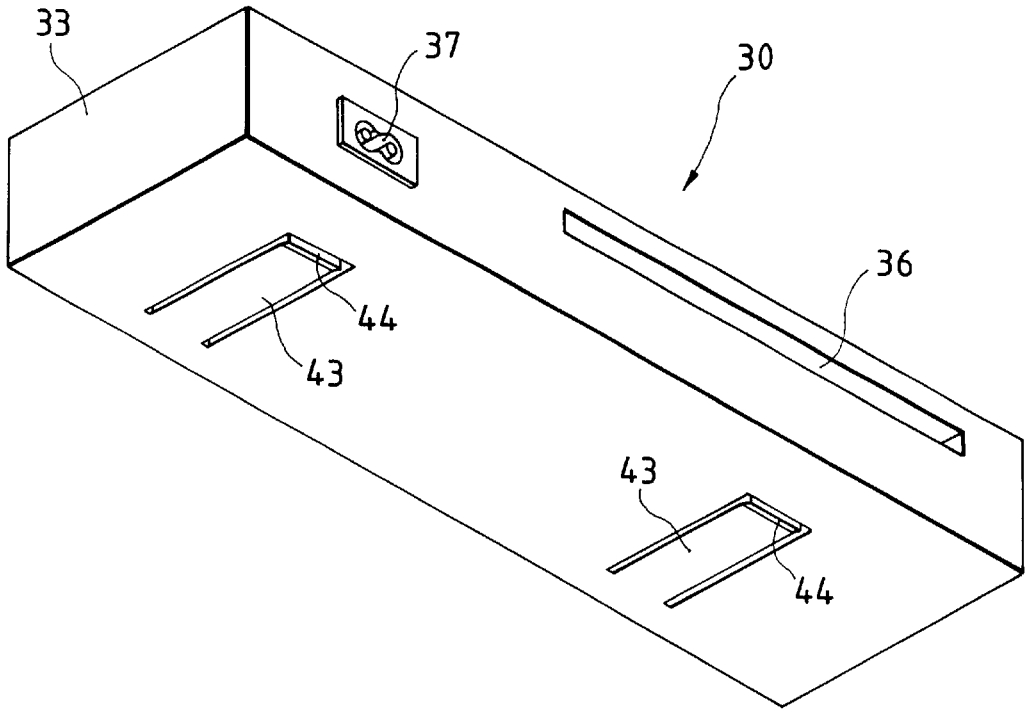
FIG. 4 is a lower, rear perspective view of a power source portion in the first embodiment of the present invention.
Figure 5:
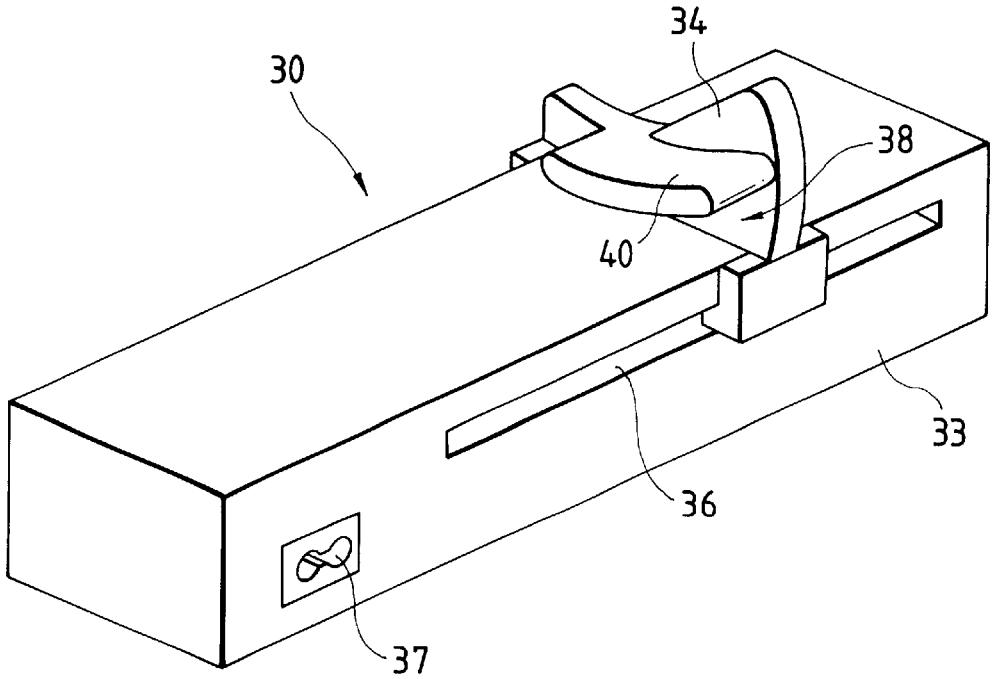
FIG. 5 is an upper, rear perspective view of the power source portion in the first embodiment of the present invention.
Figure 6:
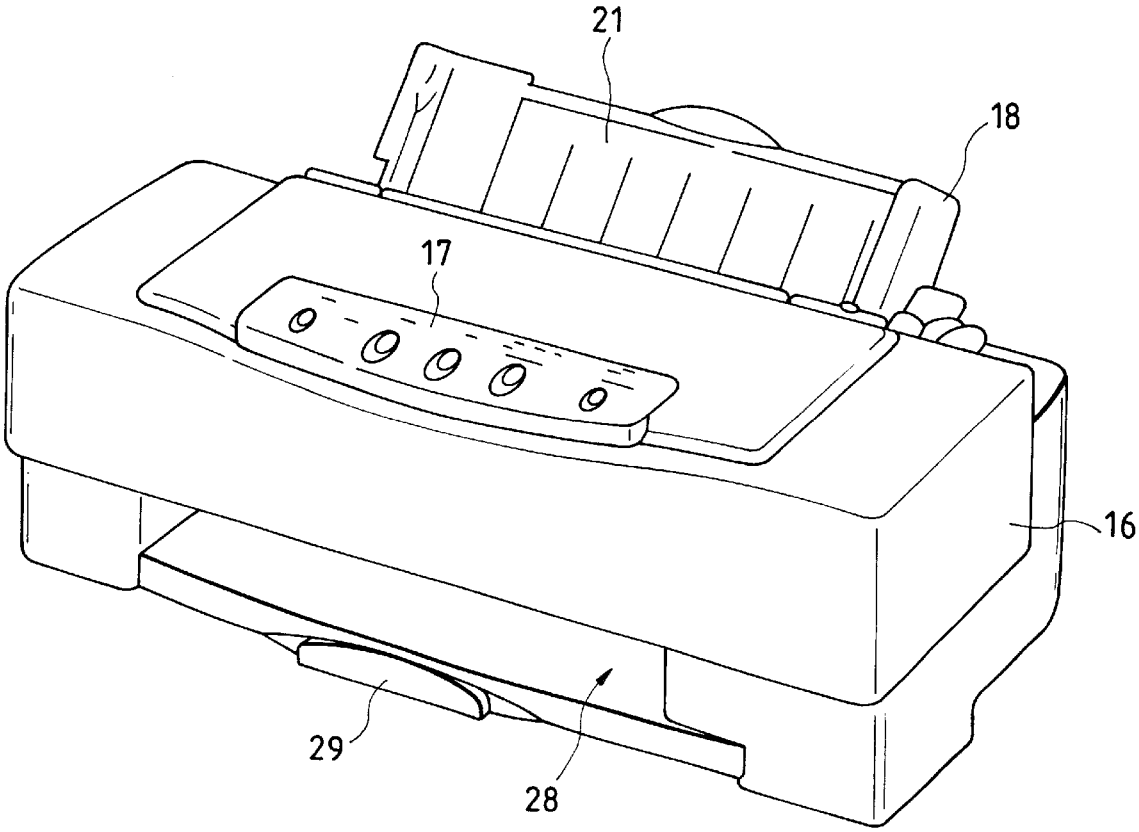
FIG. 6 is a perspective view of the first embodiment of the present invention.

The structure of an ink jet printing apparatus according to the present embodiment is schematically shown in FIG. 1, the lower portion of the back of the housing thereof is shown in FIG. 2, the cross-sectional structure of the engaged portion between the power source unit and housing thereof is shown in FIG. 3, the power source unit as it is seen from different directions is shown in FIGS. 4 and 5, and the ink jet printing apparatus according to the present embodiment is shown in FIG. 6. That is, this ink jet printing apparatus is of the so-called serial scan type which uses an ink jet cartridge 13 in which an ink jet head 11 for discharging ink from a discharge port, not shown, and an ink tank 12 storing therein the ink to be supplied to the ink jet head 11 are made integral with each other, and removably carries this ink jet cartridge 13 on a carriage, not shown, and scans and moves the carriage in the widthwise direction of a printing sheet 14 (a direction perpendicular to the plane of the drawing sheet of FIG. 1) along a platen 15 for receiving the printing sheet 14 as a printing medium.

On the upper surface of the front portion of an outer case 16 as the housing, there is provided an operating panel 17 incorporating therein switches for selecting the ON/OFF of the power source of this ink jet printing apparatus, and various printing operation modes.

Also, on the back side of the rear portion of the outer case 16, there is provided a paper supply tray 18 containing printing sheets 14 in their piled state therein. A paper supply roller 19 connected to a drive source, not shown, and intermittently rotated to thereby pay away the printing sheets 14 contained in this paper supply tray 18 one by one is rotatably journalled to this paper supply tray 18 through a roller shaft 20. Also, the upper end portion of a paper receiving plate 21 for supporting the back side of the printing sheet 14 is pivotally supported through a pin 22, and the printing sheets 14 are biased toward the paper supply roller 19 side by biasing means, not shown.

Between the platen 15 and the paper supply tray 18, a pair of upper and lower guide rollers 23 and 24 are rotatably disposed in proximity to the platen 15, and the upper guide roller 23 has its base end portion pivotally supported on a pivotally movable lever 26 through a pin 25 and is adapted to urge the printing sheet 14 against the rotatively driven lower guide roller 24 by its gravity. A pair of upper and lower pinch rollers 27 rotatively driven in operative association with the lower guide roller 24 are rotatably disposed downstream of the platen 15 along the direction of conveyance of the printing sheet 14, and the guide roller 24 and pinch rollers 27 are adapted to be intermittently driven in operative association with the scanning movement of the carriage.

In the front side of the fore portion of the outer case 16, there is formed a paper discharge port 28 for discharging the printed paper sheets 14 sent out from the pair of pinch rollers 27, and just beneath this paper discharge port 28, a paper discharge tray 29 for receiving the printed printing sheets 14 coming out of the paper discharge port 28 is mounted for movement into and out of the outer case 16.

A containing portion 31 for a power source unit 30 which will hereinafter be described in detail is formed just beneath the paper supply tray 18, and an opening portion 32 through which the power source unit 30 is removably inserted into this containing portion 31 opens in the back of the rear portion of the outer case 16. The power source unit 30 is removably mounted with respect to the containing portion 31 through the opening portion 32.

The power source unit 30 has an AC power source connection pack 33 as a drive source, not shown, for converting an AC power source into a direct current of a predetermined voltage and driving the carriage, the guide roller 24 and the pinch rollers 27, and the power source portion of the present invention for supplying electric power to a control portion or the like, not shown, for controlling these drive sources, and a sideguide 34 for manual insertion as the printing medium conveying auxiliary member of the present invention. The side guide 34 for manual insertion for bearing against the side edge portion of the printing sheet 14 and stably conveying the printing sheet 14 is restrained for sliding movement in the widthwise direction of the printing sheet 14 (a direction perpendicular to the plane of the drawing sheet of FIG. 1) relative to side guide restraining grooves 35 and 36 formed in the front and rear surfaces of the AC power source connection pack 33 in conformity with the widthwise dimension of the printing sheet 14.

A connection 37 for connecting the AC power-source connection pack 33 to the AC power source is formed on the back of the rear portion of the AC power source connection pack 33. On the side guide 34 for manual insertion, there is integrally formed an upper guide 40 forming a manual paper supply port 38 and a manual paper supply path 39 connected thereto by the flat upper surface of the AC power source connection pack 33.

Figure 13:
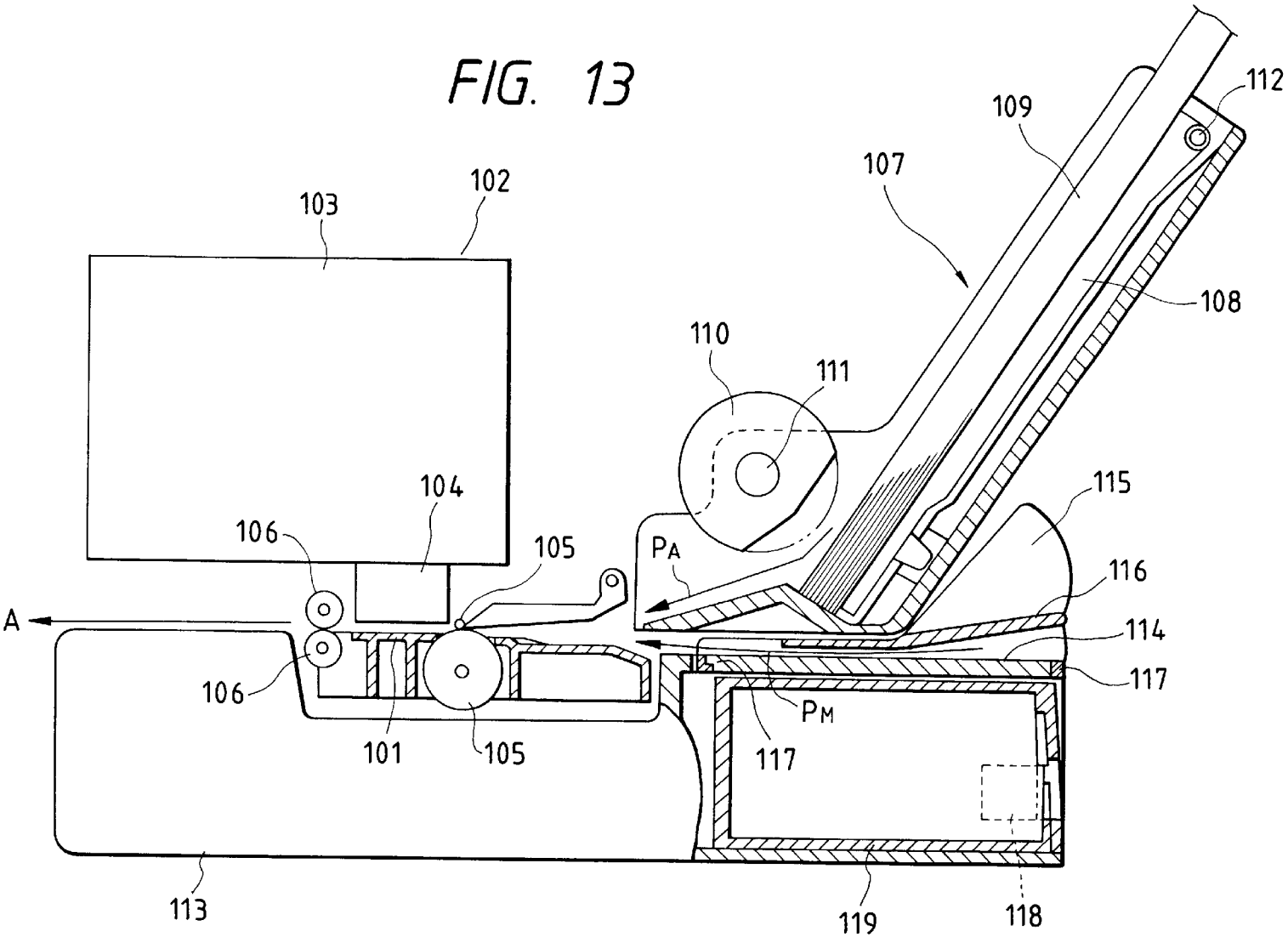
FIG. 13 is a conceptional view of a mechanism representing an example of the printing apparatus according to the prior art.

As described above, design is made such that the printing sheets 14 can be inserted between the pair of guide rollers 23 and 24 one by one through the manual paper supply path 39 leading from the manual paper path 39 leading from the manual paper supply port 38 to the pair of guide rollers 23 and 24, whereby when printing is to be effected on a printing sheet 14, the printing work can be done without the printing sheet 14 being placed on the paper supply tray 18. Also, by the upper surface of the AC power source connection path 33 being utilized as the manual paper supply path 39, the portion forming the manual conveying path $P_M$ of the outer case 113 intervening just above the power source portion 119 shown in FIG. 13 can be eliminated and therefore, the total height of the ink jet printing apparatus can be correspondingly reduced and made lighter in weight and moreover, it is possible to reduce the cost of the material of the outer case 16.

Insertion guide portions 41 opposed to the right and left side edge portions of the upper surface of the AC power source connection pack 33 are projectedly provided on the right and left side wall portions of the containing portion 31 off the manual paper supply path 39, and projected portions 42 for bearing against the upper and lower surfaces, respectively, of the AC power source connection pack 33 and effecting the positioning of the power source unit 30 relative to the containing portion 31 are provided on the lower surfaces of the insertion guide portions 41 and the bottom wall inside of the containing portion 31, respectively. Also, on the bottom surface of the AC power source connection pack 33, a leaf spring-like restraining lever 43 extending rearwardly from the front side thereof is cut away. The restraining lever 43 having a restraining pawl portion 44 formed on the tip end portion thereof has its tip end side protruded from the bottom surface of the AC power source connection pack 33, and is resiliently deformable inwardly of the AC power source connection pack 33, i.e., upwardly as viewed in FIG. 3.

On the lower inner wall of the containing portion 31, there is further projectedly provided a restraining portion 45 capable of being restrained by the restraining pawl portion 44 of the restraining lever 43 of the power source unit 30 as positioned in the containing portion 31. Also, an operating aperture 46 for pressing the restraining lever 43 from outside toward the inside of the AC power source connection pack 33 is formed in the bottom surface of the outer case 16.

Accordingly, when the power source unit 30 is to be taken out of the containing portion 31, a finger or the like is first put into the operating aperture 46 in the bottom surface of the outer case 16 and the restraining lever 43 is pushed up against the spring force thereof to thereby release the engagement of the restraining pawl portion 44 with the restraining portion 45. In this state, the power source unit 30 is rearwardly pulled from the opening portion 32, whereby the power source unit 30 can be removed from the containing portion 31.

Conversely, when the power source unit 30 is to be mounted in the containing portion 31, the power source unit 30 can be simply pushed into the opening portion 32, whereby the restraining lever 43 rises onto the restraining portion 45 while being resiliently deformed, and at a point of time whereat it has passed the restraining portion 45, the restraining pawl portion 44 is automatically restrained on the restraining portion 45 by the spring force of the restraining lever 43, and the power source unit 30 is fixed in its positioned state in the containing portion 31.

Figure 7:
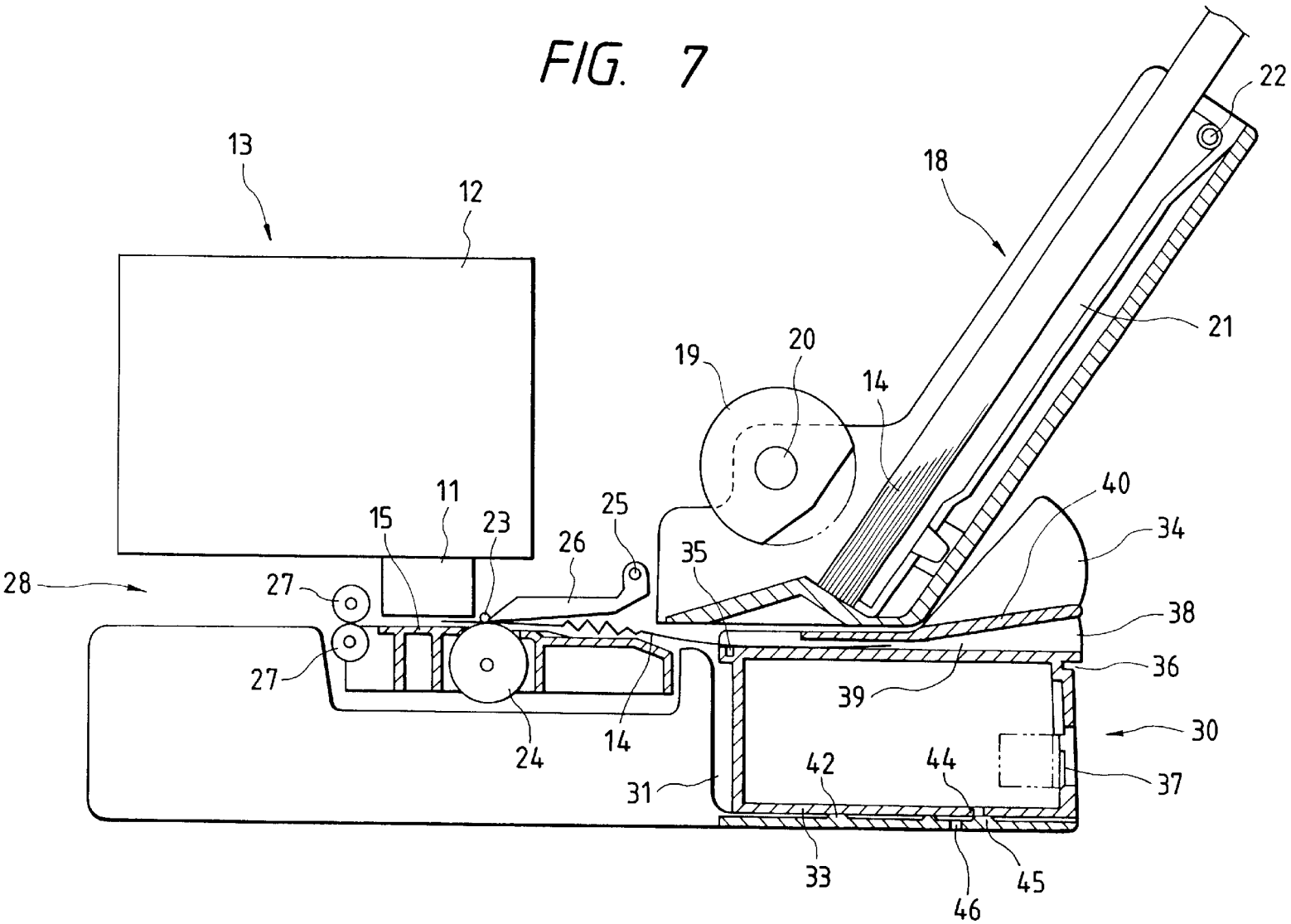
FIG. 7 is a conceptional view similar to FIG. 1 but showing a state in which improper conveyance has occurred in a manual paper supply path in the first embodiment of the present invention.

Now, when improper conveyance of the printing sheet 14 occurs in the manual paper supply path 39, the leading edge of the printing sheet 14 is pinched between the guide rollers 23, 24 and the pinch rollers 27, as shown in FIG. 7, and the trailing end edge of the printing sheet 14 has also come further into the manual paper supply path 39 than into the manual paper supply port 38. In such a case, it is very difficult to remove the printing sheet 14 which has caused improper conveyance from the outside.

Figure 8:
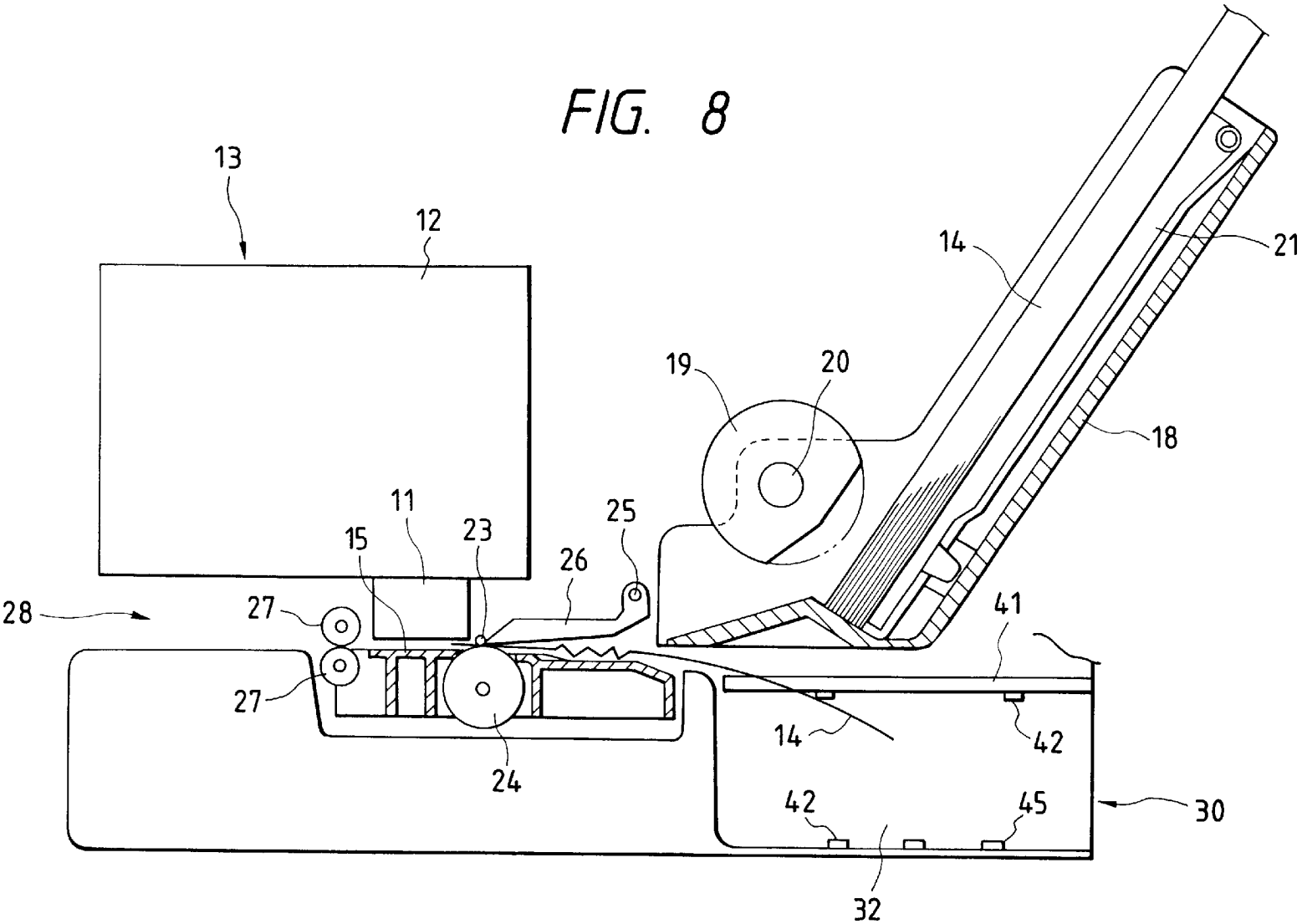
FIG. 8 is a conceptional view showing a state in which a power source unit has been removed from the state shown in FIG. 7.

In such a case, in the present embodiment, the power source unit 30 is removed from the containing portion 31 as shown in FIG. 8, whereby the trailing end of the printing sheet 14 which has caused improper conveyance hangs down into the containing portion 31, and a hand is put into this containing portion 31 to thereby grasp the trailing end of the printing sheet 14 and pull it out rearwardly, whereby the printing sheet 14 can be easily removed from the ink jet printing apparatus.

Also, in the present embodiment, the power source unit 30 is disposed at a diagonal position with respect to the operating panel 17 of the ink jet printing apparatus and therefore, even if the ink jet printing apparatus is operated during a printing operation, the power source unit 30 and the restraining lever 43 are not inadvertently touched by a hand, and the inconvenience that during the printing operation, the power source unit 30 is removed from the containing portion 31 by mistake to thereby impart damage to the ink jet printing apparatus or fail in the printing operation can be obviated.

While in the above-described embodiment the resiliently deformable restraining lever 43 is provided on the AC power source connection pack 33 side, it can also be provided on the outer case 16 side.

Figure 9:
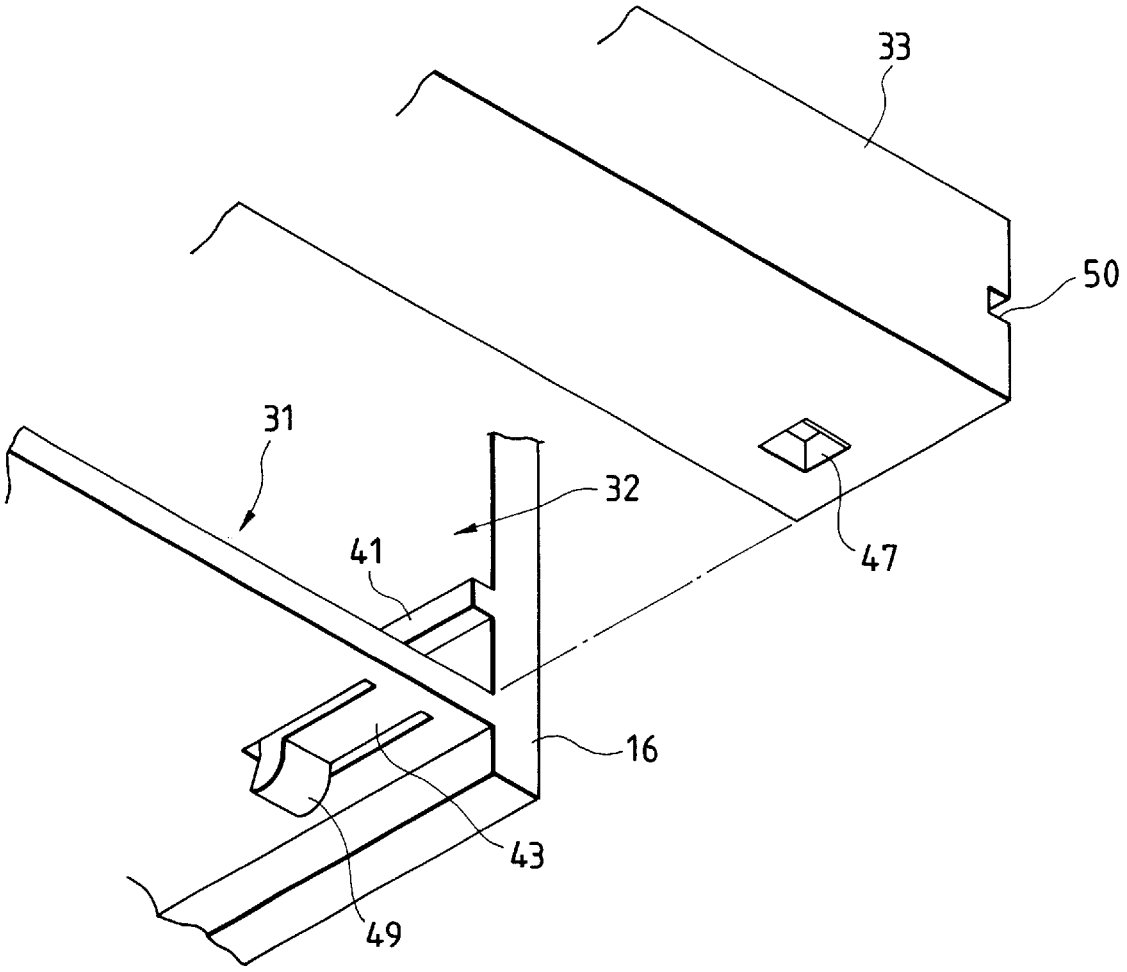
FIG. 9 is an enlarged lower, rear perspective view of a second embodiment of the printing apparatus according to the present invention.
Figure 10:
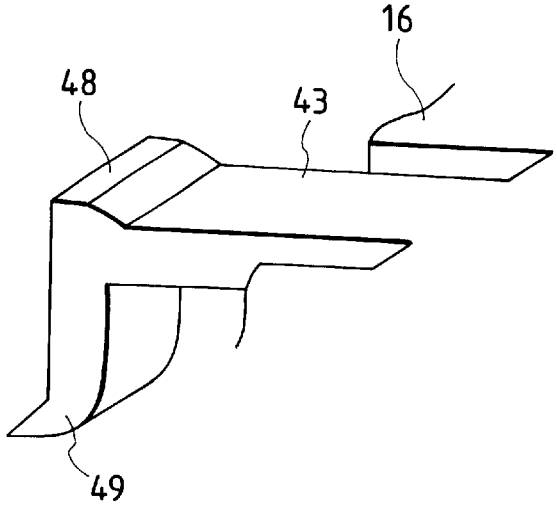
FIG. 10 is an enlarged broken-away perspective view of a finger applying portion in the second embodiment of the present invention.

FIG. 9 shows the essential portions of a second embodiment in which such a printing apparatus according to an embodiment of the present invention is applied to the structure according to the first embodiment, and FIG. 10 shows the outer case, and elements functionally similar to those in the first embodiment are given the same reference numerals and need not be described. That is, a restraining recess 47 is formed in the bottom surface of the side edge portion of the AC power source connection pack 33, and an engagement projection 48 engageable with this restraining recess 47 is projectedly provided on the bottom surface of the side edge of the containing portion 31 of the outer case 16. This engagement projection 48 is formed on the tip end portion of a restraining lever 43 cut away into the shape of a leaf spring, and a finger applying portion 49 for releasing the engagement of the engagement projection 48 with the restraining recess 47 is projectedly provided on the opposite side. That is, the power source unit 30 is pulled rearwardly with the finger applying portion 49 flexed downwardly and the engagement between the restraining recess 47 and the engagement projection 48 released, whereby the power source unit 30 can be removed from the containing portion 31.

In this case, the finger applying portion 49 is of downwardly protruded structure and therefore, the bottom surface of the outer cover 16 partitioning the containing portion 31 is upwardly positioned by the same amount as or more than the amount of protrusion of the finger applying portion 49 so that this finger applying portion 49 may not contact with the supporting surface of the ink jet printing apparatus when placed. Also, in the present embodiment, a projected portion 42 is not formed on an insertion guide portion 41 projectedly provided on the inner side wall of the containing portion 31, but an engagement groove 50 slidably engaged with the insertion guide portion 41 is formed in the side edge surface of the AC power source connection pack 33, whereby the positioning of the power source unit 30 relative to the containing portion 31 is effected.

While in the above-described embodiment a pair of restraining means such as the restraining lever 43, the restraining portion 45, the restraining recess 47 and the engagement projection 48 are provided, two pairs of such restraining means can also be provided.

Figure 11:
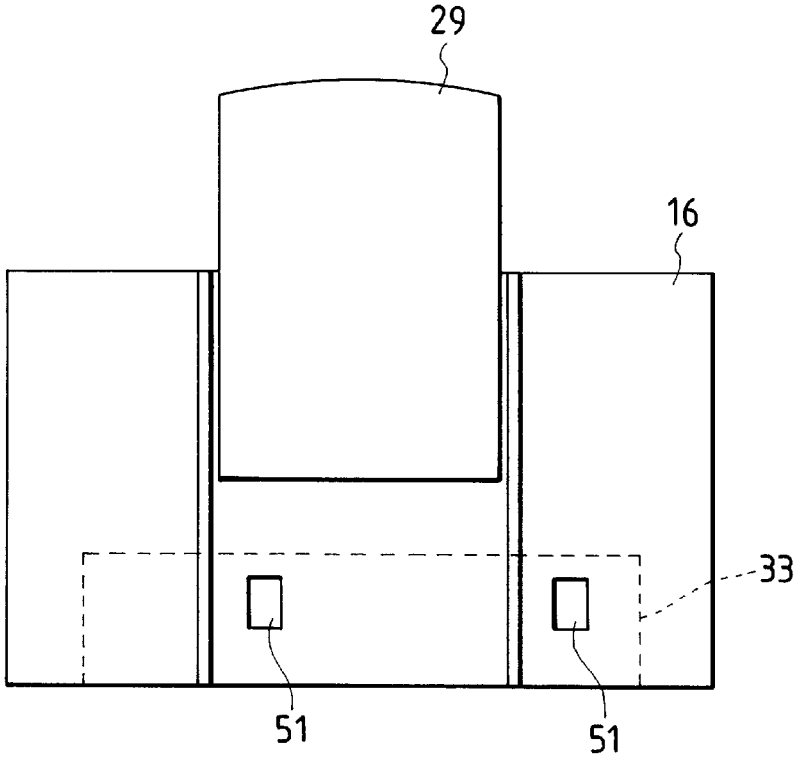
FIG. 11 is a bottom plan view of a third embodiment of the printing apparatus according to the present invention.
Figure 12:
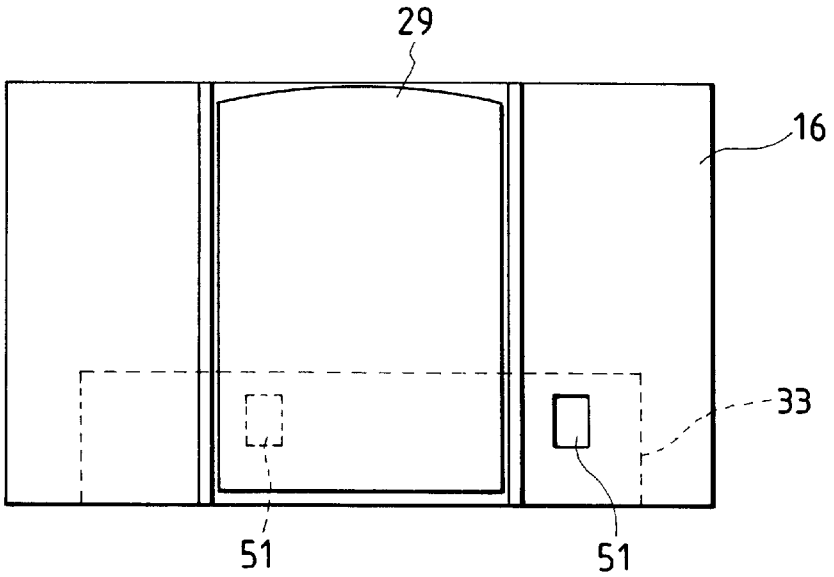
FIG. 12 is a bottom plan view of the housed state of a paper discharge tray in the third embodiment of the present invention.

FIGS. 11 and 12 show the bottom surface shape of a third embodiment in which such a printing apparatus according to an embodiment of the present invention is applied to the structure of the first embodiment, and in FIGS. 11 and 12, elements functionally similar to those in the first embodiment are given the same reference numerals and need not be described. That is, the paper discharge tray 29 which can be changed over to a used position shown in FIG. 11 and a housed position shown in FIG. 12 is slidably mounted on the bottom surface of the outer case 16, and at least one of the restraining devices of the same construction as that in the first embodiment is covered with the paper discharge tray 29 when in its housed position. That is, when the paper discharge tray 29 is in its housed position shown in FIG. 12, an operating aperture 51 may be closed by the paper discharge tray 29, and conversely, when the paper discharge tray 29 is in its used position shown in FIG. 11, a finger or the like can be inserted into this operating aperture 51.

Thereby, unless the paper discharge tray 29 is pulled out toward the used position, the restrained state of the restraining lever 43 and the restraining portion 45 cannot be released from the operating aperture 51 and therefore, particularly in the case of a printing apparatus given portability, the inconvenience that the power source unit 30 is put off the outer case 16 by mistake when the apparatus is being carried can be obviated.

In a printing apparatus according to such a preferred embodiment of the present invention, the power source unit can further have a printing medium conveying auxiliary member disposed near the path, and in this case, it is effective for the printing medium conveying auxiliary member to be movable relative to the power source portion. Also, provision may further be made of printing medium automatic supplying means for automatically supplying the printing medium and a printing medium supplying port capable of supplying the printing medium discretely from this printing medium automatic supplying means so that the supply of the printing medium may be selectively done from one of the printing medium automatic supplying means and the printing medium supplying port, and the power source portion may be disposed under the printing medium automatic supplying means.

A printing apparatus according to another preferred embodiment of the present invention may be designed such that one of a pair of restraining devices is resiliently deformable and the restrained state thereof with the other restraining device is released by this resilient deformation. In this case, it is effective to form one resiliently deformable restraining device on the power source unit and also form in the housing an operating opening for resiliently deforming this one restraining device and releasing the restrained state thereof with the other restraining device, or to form one resiliently deformable restraining device on the housing and form on said one restraining device a finger applying portion for resiliently deforming said one restraining device and releasing the restrained state thereof with the other restraining device. Also, an operating panel portion for the printing work may be provided on the upper surface of the front portion of the housing and an opening portion may be formed in the back of the rear portion of the housing. Likewise, the paper discharge tray may be provided so as to be changeable over to a used position for receiving the printing medium and a housed position retracted toward the housing side relative to the used position and two pairs of restraining devices may be provided so that at least a pair of restraining devices may be covered with the paper discharge tray when in the housed position. Further, it is also effective to provide positioning means for the power source unit relative to the containing portion.

On the other hand, the power source unit can further have a printing medium conveying auxiliary member disposed near the path and in this case, it is effective for the printing medium conveying auxiliary member to be movable relative to the power source portion. Also, provision may further be made of printing medium automatic supplying means for automatically supplying the printing mediums and a printing medium supplying port capable of supplying the printing mediums discretely from the printing medium automatic supplying means, and the supply of the printing mediums may be selectively effected from one of the printing medium automatic supplying means and the printing medium supplying port and the power source portion may be disposed under the printing medium automatic supplying means.

In these preferred embodiments, instead of the AC power source connection pack 33, a battery pack of the same configuration as this pack 33 may be carried as a power source portion in the containing portion 31, whereby it becomes possible to use the printing apparatus even in places where there is no AC power source, and the range of utilization thereof can be widened.

As described above in detail, according to the printing apparatus in accordance with the embodiments of the present invention, the path for the printing mediums is formed in the power source portion and therefore, the total height of the printing apparatus can be reduced and thus, the installation space for the printing apparatus can be reduced and the cost of the material forming the housing, etc. can be curtailed. Moreover, the power source portion can be removed from the printing apparatus and therefore, even a case where improper conveyance of the printing medium via the manual conveying path occurs can be readily coped with.

When a sideguide for manual insertion is disposed near the path of the printing medium in the power source portion for movement in a direction perpendicular to the direction of paper pass, the conveyance of the printing mediums passing along the manual conveying path can be stabilized.

On the other hand, an opening portion for putting the power source portion in and out is formed in the housing so as to face the containing portion and at least a pair of restraining devices are formed on the housing and the power source portion and the power source portion is fixed in its restrained state in the containing portion so that this restrained state can be manually released and therefore, unless the engagement of the restraining devices is released and the power source portion is pulled out of the containing portion, the power source portion cannot be removed from the containing portion, and such an accident that a user removes the power source portion during the printing operation by mistake can be obviated. Moreover, the releasing of the restraining device is possible without the use of any tool or the like and therefore, the mounting and dismounting of the power source portion can be quickly and easily effected and the maintenance property of the apparatus can be improved.

Also, when a paper discharge tray changeable over to a used position for receiving the printing medium and a housed position retracted to the housing side relative to this used position is provided on the housing and at least one of two pairs of restraining devices is designed to be covered with the paper discharge tray when in its housed position, the releasing of the restraining device cannot be effected unless the paper discharge tray is shifted to its used position and therefore, in the case of a portable printing apparatus such an accident that the power source portion comes off the housing by mistake when the printing apparatus is being carried can be reliably prevented.

Further, when design is made such that a battery pack can be used as the power source portion, the printing apparatus can be used even in a place where there is no AC power source, and the utilizability of the printing apparatus can be widened.

What is claimed is:

1. A printing apparatus having a housing formed with a containing portion in which a power source unit for supplying power for effecting printing on a printing medium is removably contained, said printing apparatus comprising:

an opening portion formed in said housing so as to face said containing portion for insertion and removal of said power source unit;

at least a pair of restraining means formed on said housing and said power source unit for fixing said power source unit in a restrained state in said containing portion, the restrained state being manually releasable; and a print medium discharge tray provided on said housing so as to be movable between a use position for receiving the printing medium and a housed position, at least one of said pair of restraining means is covered with said print medium discharge tray when in the housed position, and said at least one of said pair of restraining means is manually actuable to release said power source unit from the restrained state in said containing portion only when said print medium discharge tray is moved to the use position.

2. A printing apparatus according to claim 1, wherein one of said pair of restraining means is resiliently deformable, and the restrained state with the other of said pair of restraining means is released by resilient deformation.

3. A printing apparatus according to claim 2, wherein said one resiliently deformable restraining means is formed on said power source unit, and said housing is formed with an opening for operation for resiliently deforming said one restraining means to thereby release the restrained state with said other restraining means.

4. A printing apparatus according to claim 2, wherein said one resiliently deformable restraining means is formed on said housing, and said one restraining means is formed with a finger applying portion for resiliently deforming said one restraining means to thereby release the restrained state with said other restraining means.

5. A printing apparatus according to claim 1, further comprising an operating panel for controlling a printing operation, said operation panel being provided on an upper surface of a front portion of said housing, and wherein said opening portion is formed in a rear portion of said housing.

6. A printing apparatus according to claim 1, further comprising positioning means for positioning said power source unit relative to said containing portion.

7. A printing apparatus according to claim 1, wherein said power source unit comprises a battery pack or an AC power source connection pack connected to an AC power source.

8. A printing apparatus according to claim 1, wherein a battery pack and an AC power source connection pack connected to a power source are interchangeably insertable into said containing portion as said power source unit.

9. A printing apparatus according to claim 1, wherein said power source unit further comprises a printing medium conveying auxiliary member disposed near the conveyance route.

10. A printing apparatus according to claim 9, wherein said printing medium conveying auxiliary member is movable relative to an outer housing of said power source unit.

11. A printing apparatus according to claim 1, further comprising printing medium automatic supplying means for automatically supplying the printing medium, and a printing medium supplying port for supplying the printing medium discretely from said printing medium automatic supplying means, and wherein supply of the printing medium is selectively effected from one of said printing medium automatic supplying means and said printing medium supplying port, and an outer housing of said power source unit is disposed under said printing medium automatic supplying means.

12. A printing apparatus according to claim 1, further comprising a mounting portion for an ink jet head for discharging ink to the printing medium to thereby effect printing.

13. An electrical power unit removably contained in a containing portion of a recording apparatus, an outer surface of a housing of said electrical power unit defining a part of a conveyance route for conveying a recording medium, said electrical power unit comprising:

an attaching portion for attaching said electrical power unit to the recording apparatus when said electrical power unit is disposed in the containing portion of the recording apparatus; and a guide member provided on the outer surface of the housing and being movable in a widthwise direction of the recording medium when contained in the recording apparatus to guide a widthwise edge of the recording medium along a conveyance direction.

* * * * *